US008695131B2

(12) United States Patent
Thomas

(10) Patent No.: US 8,695,131 B2
(45) Date of Patent: Apr. 15, 2014

(54) WALL FASTENER FOR TUB SURROUND

(75) Inventor: Brent Thomas, Savannah, TN (US)

(73) Assignee: Masco Bath Corporation, Moorestown, NJ (US)

( * ) Notice: Subject to any disclaimer, the term of this patent is extended or adjusted under 35 U.S.C. 154(b) by 2013 days.

(21) Appl. No.: 11/743,251

(22) Filed: May 2, 2007

(65) Prior Publication Data

US 2008/0271385 A1 Nov. 6, 2008

(51) Int. Cl.
*A47K 3/16* (2006.01)

(52) U.S. Cl.
USPC ..... 4/595; 4/584; 4/612; 4/610; 52/35

(58) Field of Classification Search
USPC ..... 4/595, 548, 612, 228.1, 584; 52/288.1, 52/702, 35, 34; 29/413
See application file for complete search history.

(56) References Cited

U.S. PATENT DOCUMENTS 3,588,925 A * 6/1971 Kuypers ..... 4/595
3,643,303 A * 2/1972 Kanarek ..... 29/413
4,817,344 A * 4/1989 Wissinger ..... 52/35
5,953,862 A * 9/1999 Earhart et al. ..... 52/98
6,691,339 B1 * 2/2004 Thomas ..... 4/610
2008/0127406 A1 * 6/2008 Hammond ..... 4/538

* cited by examiner

*Primary Examiner* — Gregory Huson
*Assistant Examiner* — Lauren Heitzer
(74) *Attorney, Agent, or Firm* — Carlson, Gaskey & Olds, PC

(57) ABSTRACT

A tub assembly is provided with a tub and a surround wall. The surround wall is spaced from a nail flange on the tub by a desired distance with a simple wall fastener. The wall fastener clips onto the nail flange, and has a forward face spaced from the nail flange by a desired distance. The forward face provides a stop and securement surface for the surround wall. The wall fastener includes a clip portion that clips onto the nail flange, and has a plurality of discrete clip portions. The clip portions can be broken away from the wall fastener at locations which will be aligned with a wall stud. In this manner, the wall fastener can be quickly clipped onto the nail flange of the tub once the tub is installed. The surround wall can then be simply adhered to a forward face of the wall fastener, such that the entire tub assembly can be easily and properly assembled.

7 Claims, 2 Drawing Sheets

WALL FASTENER FOR TUB SURROUND

BACKGROUND OF THE INVENTION

This application relates to a horizontally extending wall fastener for properly positioning a wall surround relative to a tub.

Modern bathrooms are often formed by molded plastic tubs, and matching tub surrounds that provide covering for the walls above a tub area. Typically, the tub is formed as one piece, and the walls are formed of two or three pieces. The several pieces must be secured together. It is typical that the tub has been provided with a nailing flange that is nailed to studs on a structural wall. The surround wall is then adhered to the tub by some form of adhesive connection. It is also typical that the tub is formed of some stop surface such that the wall can abut the stop surface to position the two parts.

It would be desirable to form a more secure and simple construction.

SUMMARY OF THE INVENTION

In a disclosed embodiment of this invention, a horizontal wall fastener is provided for properly positioning a surround wall relative to a tub. In a disclosed embodiment, the horizontal fastener clips over a nail flange on the tub, after the tub has been secured to studs in a wall.

In a disclosed embodiment, the wall fastener is provided with a plurality of spaced clips. The clips can be broken off at locations associated with a wall stud. A forward face of the fastener extends away from the studs, and provides a stop surface for properly positioning the surround wall. The surround wall may be secured to the fastener by an adhesive on one or the other of the members.

These and other features of the present invention can be best understood from the following specification and drawings, the following of which is a brief description.

DETAILED DESCRIPTION OF THE PREFERRED EMBODIMENT

Figure 1:
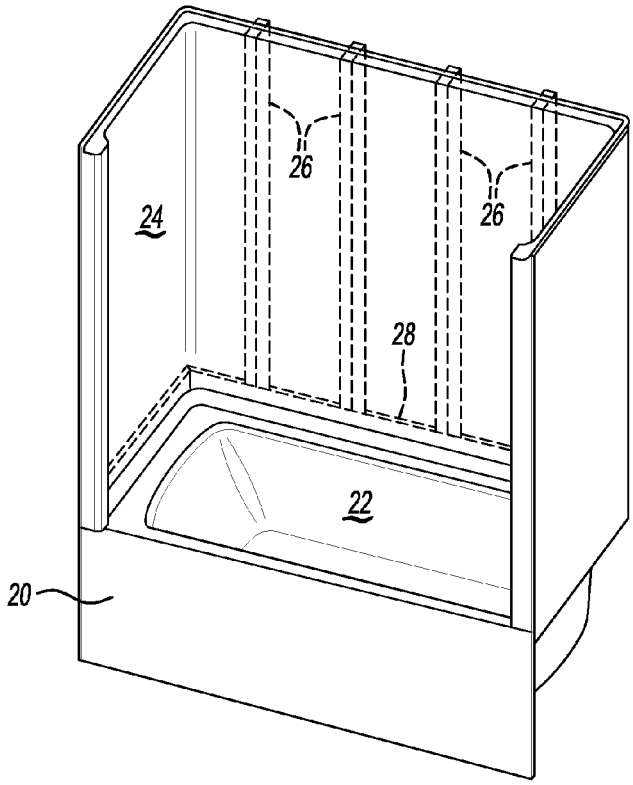
FIG. 1 schematically shows a tub area.

FIG. 1 shows a tub 20 having a bathing area 22 and surrounded by a tub surround wall 24. As known, the surround wall 24 is typically formed of a plurality of separate members. It is known to form the walls of two or three members. As known, structural wall studs 26 are used for securing the tub 20 and the tub surround 24. In FIG. 1, the location of a horizontal wall fastener 28 is shown in phantom. In fact, the member would not be visible when the tub 20 and surround 24 are assembled. The same is true of wall studs 26.

Figure 2:
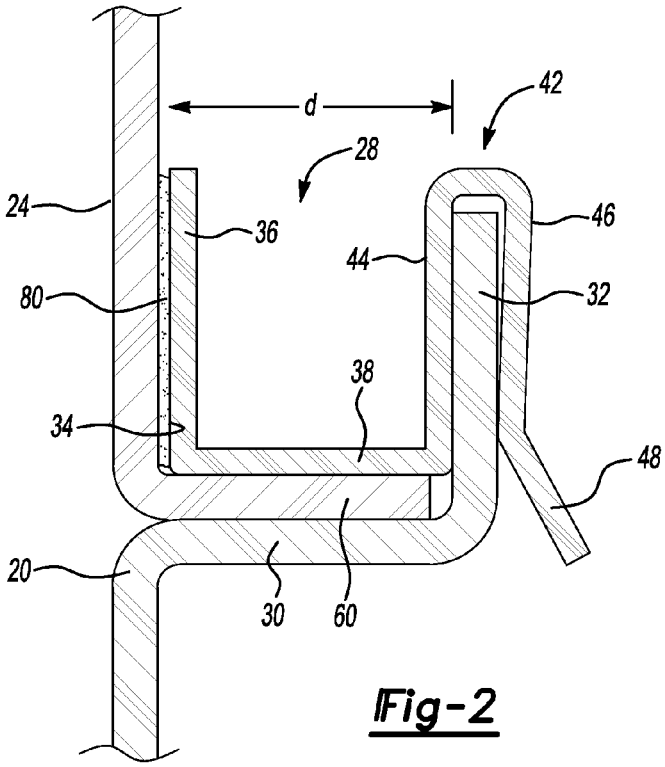
FIG. 2 is a cross-sectional view showing the inventive fastener securing a wall to a tub.

FIG. 2 is a cross-sectional view showing a horizontally extending flange 30, and a nailing flange 32 on the tub 20. As known, the nailing flange 32 is utilized as a location for nailing the tub 20 to the studs 26. The wall fastener 28 has a clip 42 clipped over the nail flange 32. As shown, the wall fastener 28 has a forward face 36, a lower face 38 which is associated with the flange 30, and clips 42. Clips 42 have an outer upwardly extending portion 44, and a downwardly extending portion 46 which leads to a bent foot 48.

In assembling the tub 20 and fastener 28, the tub 20 may be initially installed and nailed to the studs through the nail flange 32. Fastener 28 may then be snapped over the nail flange 32. The surround wall 24 has an inner face 34 which is then brought against the face 36 of the fastener 28. As shown, an adhesive layer 80 is positioned between the two, and serves to connect the tub surround 24 to the fastener 28. A distance d is maintained between the tub surround 24 and the nail flange 32 by the fastener 28. The length of the face 38 is designed to create a desired distance d between surround wall 24 and nail flange 32. A flange 60 on the surround wall sits between face 38 and flange 30.

At a vertically higher location, the wall curves back in across distance d such that it can be secured to the wall studs 26.

Figure 3:
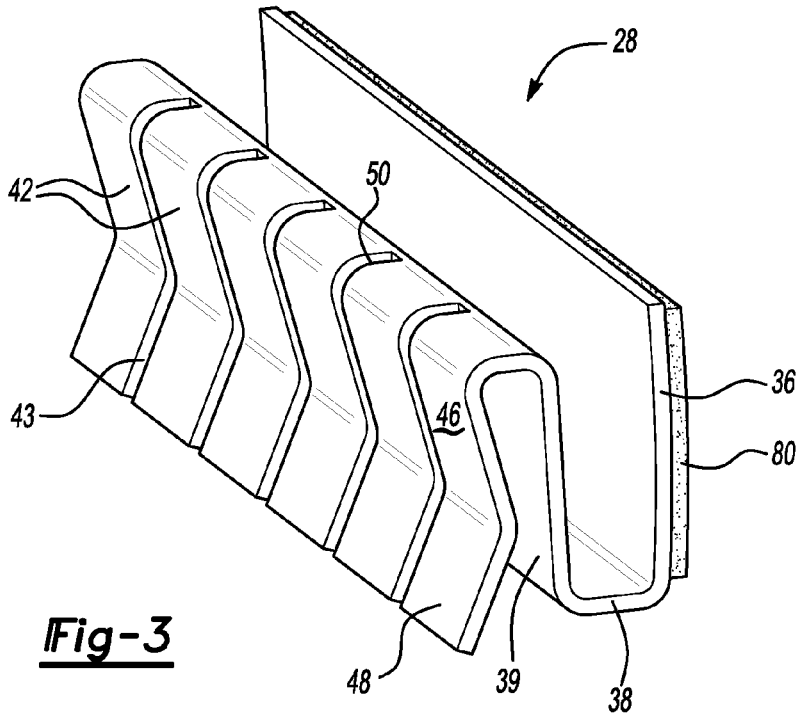
FIG. 3 is a perspective view of the inventive fastener.
Figure 4:
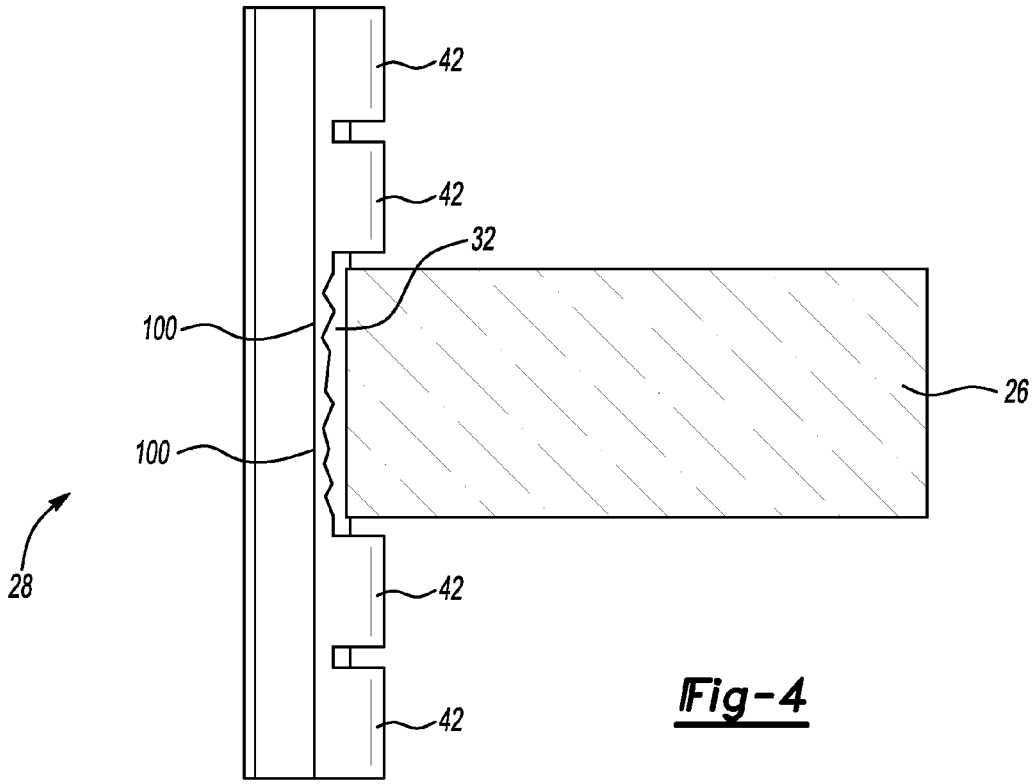
FIG. 4 is a view showing a feature of the inventive wall fastener.

As shown in FIG. 3, the clip 28 includes the adhesive layer 80, and a plurality of clip members 42. The horizontal fastener 28 may extend for the entire length of the tub 20, or can be provided in shorter lengths. As can be appreciated from FIG. 4, the separate clip members, or clip elements, 42 can be broken off at locations 100 aligned with the wall studs 26. Thus, the clip 28 can be simply snapped over the already installed tub 20 and then can facilitate a quick and accurate positioning of the tub surround 24. As can be appreciated, the separate clip members 42 are spaced by intermediate spaces 43 to make them more easily broken. As can be seen, each clip member 42 has a downwardly extending portion, leading to a bent foot, and there being a space between adjacent ones of said discrete clips.

The present invention thus provides a simplified method of assembling a surround wall to a tub. The wall fastener is formed of an appropriate plastic material.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A tub assembly comprising:

a tub defining a bathing area and having a nailing flange for securing the tub to a building;

a surround wall for surrounding the tub;

a fastener for being secured between the tub and the surround wall, and for positioning the surround wall relative to the nailing flange; and an adhesive provided on a forward face of said fastener, wherein said fastener clips onto said nailing flange, and wherein said forward face is spaced from the nailing flange to provide a desired distance between the surround wall and the nailing flange, and wherein said fastener has a plurality of clip elements for being secured onto said nailing flange, and said clip elements being capable of being broken off at locations which will be aligned with a wall stud when the tub assembly is assembled into a building.

2. The tub assembly as set forth in claim 1, wherein said fastener includes an outwardly extending portion that extends from a clip portion clipped onto said nailing flange and to said forward face, said outwardly extending portion being designed to provide said desired distance between the surround wall and the nailing flange.

3. The tub assembly as set forth in claim 1, wherein said clip elements include a plurality of clips that clip onto the nailing flange, and which can be each broken off as desired.

4. The tub assembly as set forth in claim 1, wherein said adhesive is provided between the forward face of the fastener and the surround wall for securing the two.

5. A wall fastener for securing a surround wall to a tub comprising:

a clip portion for being clipped onto a nail flange of the tub, said clip portion extending into an outwardly extending portion, said outwardly extending portion extending to a forward face;

said forward face being spaced from said clip portion by a distance defined by said outwardly extending portion, said forward face providing a securement surface for securing a surround wall, and spacing the surround wall from the nail flange;

said clip portion has a plurality of discrete elements for being secured onto said nail flange, and said discrete elements being capable of being broken off at locations which will be aligned with a wall stud when the tub assembly is assembled into a building; and an adhesive provided on said forward face of said wall fastener.

6. A method of providing a tub and surround wall comprising the steps of:

(1) mounting a tub within a location in a building, and securing a nail flange of the tub to the building;

(2) clipping a wall fastener on the nail flange, the wall fastener having a first portion to be received on the nail flange, and a forward face spaced from the first portion;

(3) abutting a surround wall against said forward face of the fastener to position the surround wall relative to the nail flange;

(4) forming said first portion of the wall fastener with a plurality of discrete elements, and ones of said discrete elements that would be aligned with wall studs on the building are broken away from the clip portion.

7. The method as set forth in claim 6, wherein an adhesive is provided on said forward face of said wall fastener.

* * * * *